US005465888A

United States Patent [19]

Owens

[11] Patent Number: 5,465,888

[45] Date of Patent: Nov. 14, 1995

[54] CHILD CARE ACCESSORY CYCLING BELT

[76] Inventor: Kathleen P. Owens, 2567 Landview Cir., Virginia Beach, Va. 23454

[21] Appl. No.: 189,146

[22] Filed: Jan. 31, 1994

[51] Int. Cl.[6] ..... H45F 5/00

[52] U.S. Cl. ..... 224/224.0; 224/148; 224/153

[58] Field of Search ..... 224/148, 153, 224/182, 184, 219, 222, 223, 224, 227, 228, 268, 269, 272, 920, 215, 904, 211, 254, 151

[56] References Cited

U.S. PATENT DOCUMENTS

| | | | |
|---|---|---|---|
| 2,356,209 | 8/1944 | Brilhart | 224/268 |
| 2,494,632 | 1/1950 | Rodin | 224/148 |
| 2,558,382 | 6/1951 | Previdi | 224/223 |
| 3,077,292 | 2/1963 | Gehrke | 224/184 |
| 3,317,098 | 5/1967 | Auraen | 224/254 |
| 4,318,502 | 3/1982 | Lowe et al. | 224/211 |
| 4,322,077 | 3/1982 | Van't Hof | 224/219 |
| 4,449,654 | 5/1984 | Cappis | 224/148 |
| 4,498,613 | 2/1985 | Donahue et al. | 224/148 |
| 4,564,957 | 1/1986 | Scharf | 224/148 |
| 4,693,402 | 9/1987 | Comeau | 224/215 |
| 4,732,305 | 3/1988 | Courtney et al. . | |
| 4,923,105 | 5/1990 | Snyder | 224/227 |
| 4,925,070 | 5/1990 | Tulgan | 224/209 |
| 5,012,964 | 5/1991 | Falletta et al. | 224/153 |
| 5,040,711 | 8/1991 | Niederhauser et al. | 224/228 |
| 5,082,156 | 1/1992 | Braun | 224/254 |
| 5,130,899 | 7/1992 | Larkin et al. | 224/219 |
| 5,169,043 | 12/1992 | Catania | 224/224 |
| 5,228,609 | 7/1993 | Gregory | 224/224 |

FOREIGN PATENT DOCUMENTS

| | | | |
|---|---|---|---|
| 1131258 | 2/1957 | France | 224/209 |
| 111240 | 5/1967 | Norway | 224/209 |

OTHER PUBLICATIONS

J.A.M.A.; vol. 168, No. 7, p. 930, Oct. 18, 1958.

P. 44 of Road Runner Sports Catalogue, Winter, 1993.

*Primary Examiner*—Henry J. Recla

*Assistant Examiner*—Gregory M. Vidovich

*Attorney, Agent, or Firm*—Richard C. Litman

[57] ABSTRACT

Multiple embodiments are disclosed of a cycling belt to be worn by a main rider seated on a main seat of a cycle and which is for use when cycling with a child or infant in a child carrier seat, preferably a carrier seat mount to the rear of the main seat. The cycling belt comprises a band portion which is adjustable in length and which is removably fastenable around the waist of the main rider. A closable pouch for storing basic child care items is attached to the band portion so as to be centerable upon the main rider's lower back. Pockets are further attached about the cycling belt for storing child play and care items, the items of which can be removably fastened to tether assemblies which removably fasten to attachment fittings on the cycling belt.

7 Claims, 3 Drawing Sheets

CHILD CARE ACCESSORY CYCLING BELT

BACKGROUND-FIELD OF INVENTION

This invention relates generally to cycling belts, and more particularly such cycling belts for use when cycling with a child in a child carrier seat.

BACKGROUND-DISCUSSION OF PRIOR ART

Cycling with a child or infant in a child carrier seat, particularly a seat mounted to the rear of the main seat, presents several challenges to the parent or main rider seated on the main seat. These include maintaining the child's happy disposition and having basic child care needs, such as diapers, baby wipes, food and bottles, at hand throughout the cycling trip. Frequently, the child will become bored and cranky with lack of items to keep his/her attention. It is desirable to be able to furnish the child with several different play items or a bottle of refreshment while riding. However, these items would cause several problems if dropped to the ground while riding. These problems include a safety hazard to the riders if the item falls in the pedal or wheel assembly, disruption of the cycling trip by having to retrieve the item, and breakage or damage of the item from impacting the ground. Therefore, a need exists to provide a means for preventing the items from falling to the ground, or an unsafe area of the cycle, when dropped. A need also exists to provide easily accessible storage for such items when not in use such that the main rider can easily remove and replace the items while riding. An additional need exists for these items, when dropped, to be easily retrievable by the parent rider while riding. Yet another need exists to provide convenient storage for basic child care items such as diapers, baby wipes, and food. Furthermore, it is desirable for all these elements to be combined in the form of a belt such that these elements can be quickly and easily removed from the main rider when cycling without a child in a carrier seat.

Several belt configurations are identified in prior art but none are specifically designed or suited for cycling with a child in a carrier seat.

For example, utility belts are currently available. These belts are formed with a belt of webbing or the like which secures around a workman's waist by an adjustable buckle. The belts comprise several removable or integrated components specifically designed for storing trade items such as nails and hammers. However, none of these prior art designs provide sufficient storage for basic child care items. They additionally lack a means for preventing a child care or play item from falling to the ground if dropped and also lack easily accessible storage for such items such that the main rider can easily insert and remove the items while riding.

Additionally, underwater diver's weight belts are currently available. Most are commonly formed with a belt of webbing or the like which secures about the diver's waist by an adjustable buckle. These belts comprise several removable, adjustable or integrated components specifically designed for storing diver's weights and accessories. However, none of these prior art designs provide suitable storage for basic child care items. They also lack a means for preventing a child play or care item from falling to the ground if dropped and additionally lack easily accessible storage for such items as described previously.

Sport belts are also currently available and are most commonly formed with a belt of webbing or the like which secures around the sportsman's waist by an adjustable buckle. These belts comprise an integrated pouch designed to fall across the sportsman's back for storing articles. Different sport belts have been designed to suit specific sports such as belts for jogging and belts which hold specific items such as cassette decks. However, none these prior art designs are specifically designed for cycling nor do they provide means of preventing a child care or play item from falling to the ground if dropped. They additionally lack easily accessible storage for such items as described previously.

Hence, there are no known belt configurations particularly adapted to solve all of the identified problems associated with cycling with a child in a carrier seat.

Objects and Advantages

Accordingly, several objects and advantages of the present invention are:

a) to provide a cycling belt to be worn by the parent or main rider seated on the main seat of a cycle and which comprises components which are particularly useful when cycling with a child or infant seated in a child carrier seat.

b) to provide such a cycling belt which is adjustable in length for adapting the cycling belt to different waist sizes and which additionally comprises a removable fastener for fastening the belt about the rider's waist.

c) to provide a cycling belt of the type referred to above including a pouch for storing basic child care items as previously described and which may be centered on the rider's back when worn, such a pouch comprising an opening large enough to insert and remove such items and additionally comprising a flap for closing and securing the opening of the pouch.

d) to provide a cycling belt of the type referred to above including pockets for storing child play and care items when not in use, such pockets being easily accessible by the main rider such that the main rider can easily insert and remove such items while riding.

e) to provide a cycling belt of the type referred to above including a number of tether assemblies having one end which is removably fastenable to the cycling belt and an opposite end which is removably fastenable to a child play or care item to the ground or an unsafe area of the cycle if dropped by the child.

f) to provide a cycling belt of the type referred to above including attachment fittings for the tether assemblies.

Additional objects and advantages of the invention are made apparent in the following description having reference to the accompanying drawings.

DRAWING FIGURES

List of Reference Numerals

Figure 1:
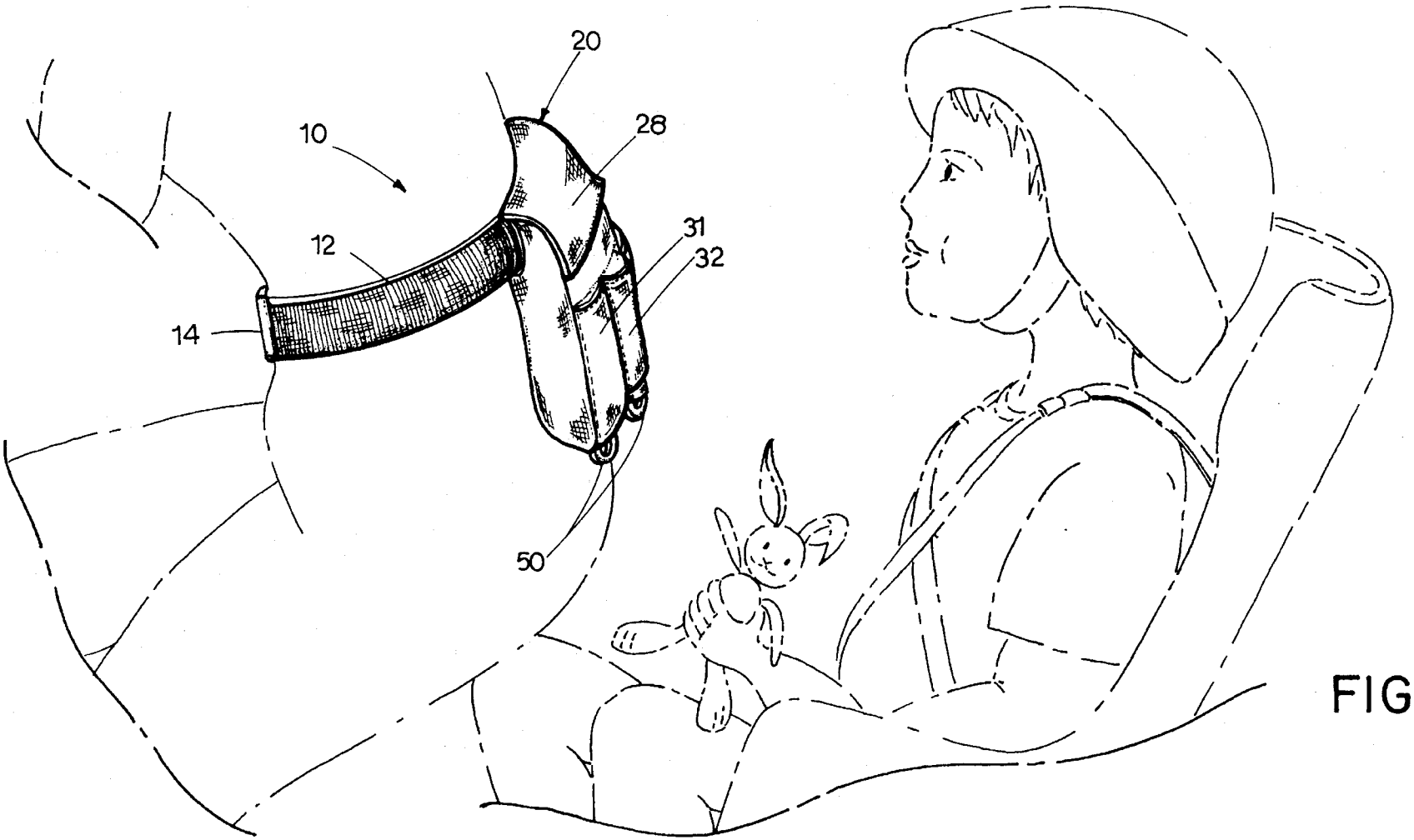
FIG. 1 is a perspective view of the cycling belt secured about the waist of a main rider on a bicycle with a child in a carrier seat and which illustrates the use of all of the components of the cycling belt.
Figure 3:
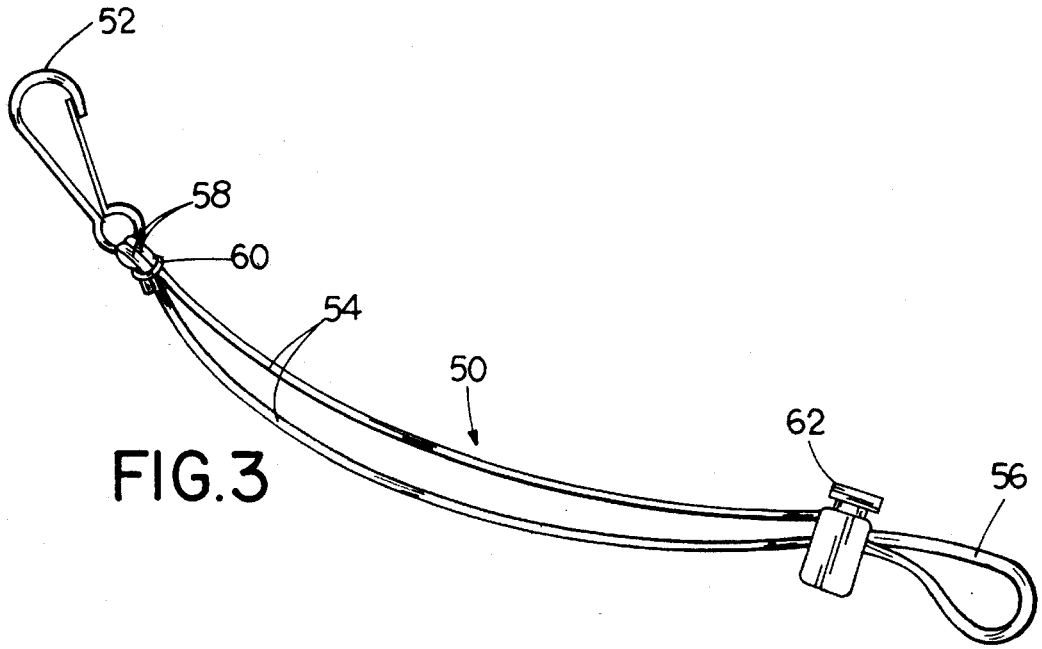
FIG. 3 is a perspective view of a tether assembly of the cycling belt.
Figure 4:
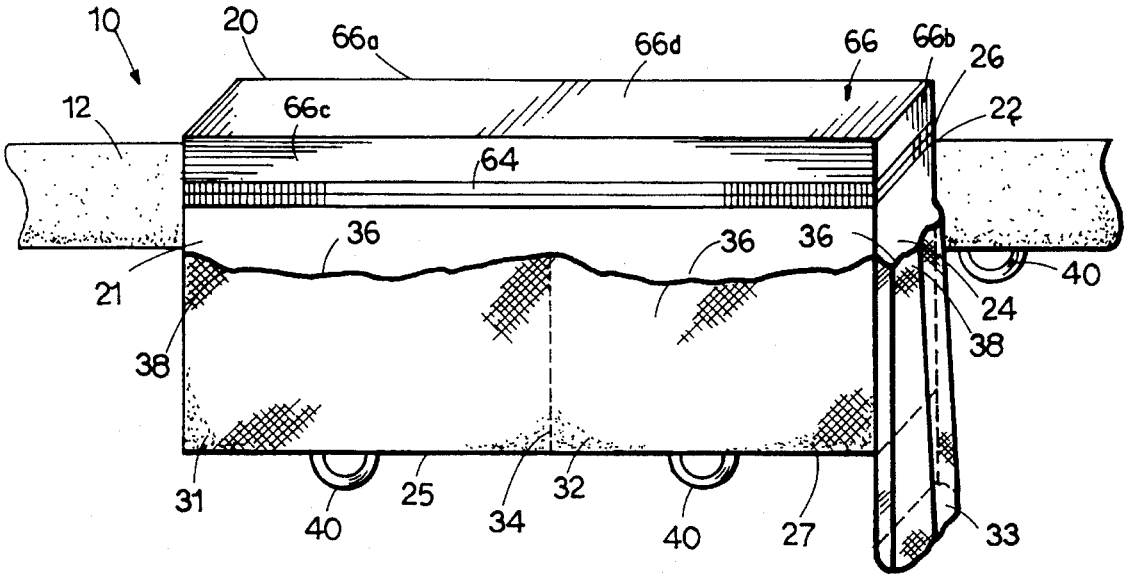
FIG. 4 is a fragmentary view of another embodiment of the cycling belt.

| | | | |
|---|---|---|---|
| 10 | cycling belt of FIGS. 1&2 | 31 | pocket |
| 10' | cycling belt of FIG. 4 | 32 | pocket |
| 12 | band | 33 | cylindrical pocket |
| 14 | buckle assembly | 34 | seam |
| 14a | latch | 36 | opening of pocket |
| 14b | clasp | 38 | elasticized neck |
| 16 | adjustable end of band | 40 | attachment fittings |
| 18 | secured end of band | 50 | tether assembly of FIGS. 1 and 3 |
| 20 | pouch | 52 | clip |
| 21 | outer wall of pouch | 54 | line |
| 22 | back wall of pouch | 56 | loop |
| 23 | side edge of outer wall of pouch | 58 | ends of line |
| 24 | side of pouch | 60 | crimped metal |
| 25 | bottom edge of outer wall of pouch | 62 | locking mechanism |
| 26 | opening of pouch | 64 | slide fastener |
| 27 | bottom of pouch | 66 | flap of FIG. 4 |
| 28 | flap of FIGS. 1 and 3 | 66a | backwall of flap |
| 28a | lip of flap | 66b | side of flap |
| 30a | hook strip | 66c | lip of flap |
| 30b | latch strip | 66d | top of flap |

DESCRIPTION OF PREFERRED EMBODIMENTS

Figure 2:
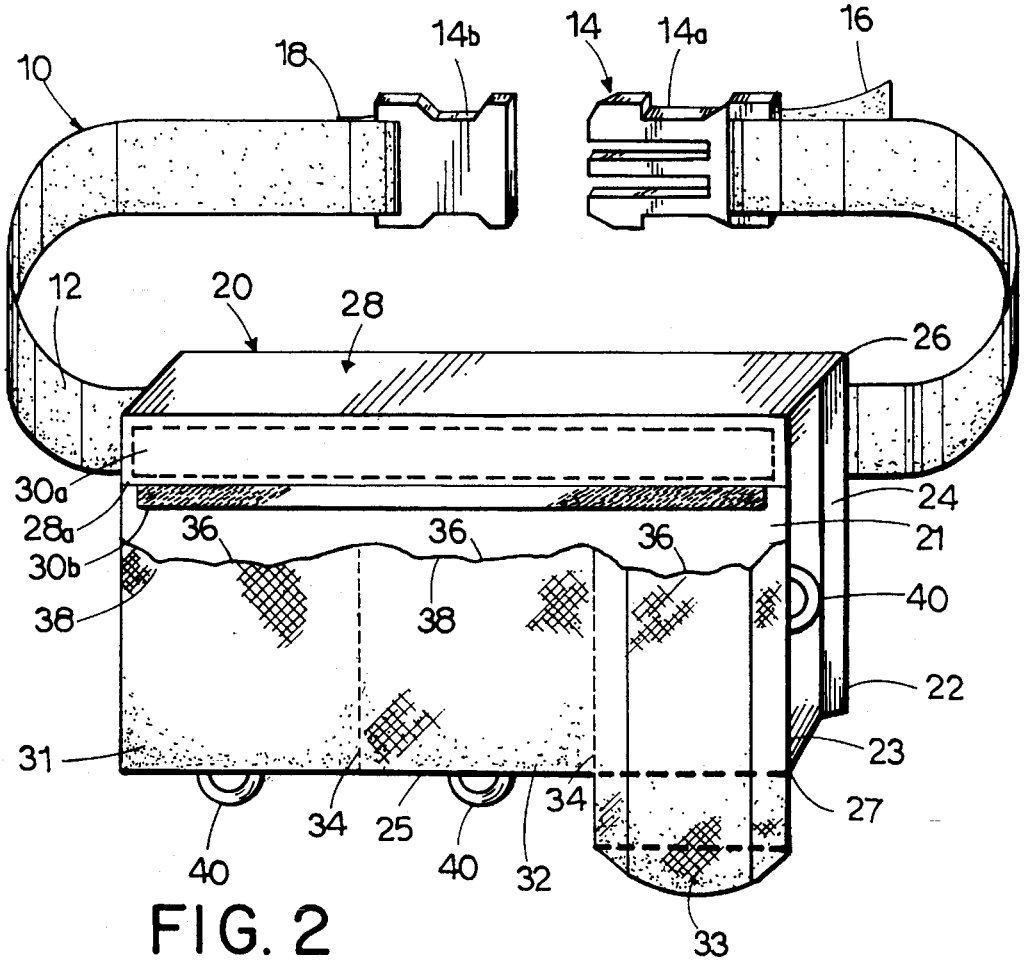
FIG. 2 is a perspective view of one embodiment of the cycling belt without tether assemblies attached.

Referring now to the drawings, a cycling belt of the type referred to above is indicated as 10 in each of FIGS. 1 and 2. Another embodiment of a cycling belt including the same components as cycling belt 10 but in a different configuration is indicated as 10' in FIG. 4.

Cycling belt 10 of FIGS. 1 and 2 comprises a band portion 12, a pouch 20, and a plurality of pockets 32*a*, 32*b*, and 32*c*. The band 12 comprises a buckle assembly 14 attached at its ends. The buckle assembly 14 includes a latch 14*a* through which a band end 16 is slidably threaded to allow of the belt for a desired adjustment in length for fit. The buckle assembly 14 includes a clasp 14*b* to accept the latch 14*a* to lock the buckle assembly. An end of the band 18 is securely fastened to the clasp 14*b*. This configuration for the band 12 is also intended as the preferred embodiment of the band 12 in the fragmentary view of cycling belt 10' in FIG. 4.

The cycling belt 10 of FIGS. 1 and 2 includes an expandable pouch 20 which comprises a back wall 22, sides 24, a bottom 27, an outer wall 21, an opening 26, and a flap 28. The pouch 20 is securely fastened to the band 12 such as by sewing the back wall of the pouch 22 to the band 12 so as to be centered on the wearer's back when worn. Sides of the pouch 24 are pleated to facilitate expansion of the pouch. The pouch opening 26 is covered by the flap 28 which is shaped such that when folded over the opening of the pouch 26, it covers the entire opening of the pouch 26 throughout all expandable regions of the pouch 20 with a lip portion 28*a* which extends past the outer wall of the pouch 21. A hook-type closure strip 30*a* is attached to the underside of the lip portion of the flap 28*a* and a latch-type closure strip 30*b* is attached to the outer wall of the pouch 21.

Two expandable pockets 31 and 32 are attached to the outer wall of the pouch 21 such as by sewing and are further separated by a seam 34. A pocket 33 is cylindrically shaped and is similarly attached to the outer wall of the pouch 21 and is separated from pocket 32 by another seam 34. All pockets 31, 32 and 33 comprise an opening 36 and an elasticized neck at the opening 38.

Clip or loop type attachment fittings, preferably in the form of D-rings, are indicated at 40 and are attached to the bottom edge of the outer wall of the pouch 25 centered under the corresponding pockets 31 and 32, and to the side edge of the outer wall of the pouch 23 corresponding to pocket 33.

Referring now to FIG. 3, a tether assembly 50 is shown comprising a clip or other such fastener 52, a line, rope or cord 54 and a spring operated locking mechanism 62. Both ends of the line 58 are threaded through the locking mechanism 62 to form a loop 56 on one side of the locking mechanism 62. Both ends of the line 58 are then threaded through the clip 52 and secured to the line 54 by crimped metal, a knot or other such fastener 60. This configuration for the tether assembly 50 is the preferred embodiment of the tether assembly 50 of cycling belt 10 and cycling belt 10'.

The band 12 of cycling belt 10 of FIGS. 1 and 2 can be composed of a webbing type material with sufficient stiffness or which can be fabricated as such to provide support for all described components of the cycling belt 10 without substantially sagging or drooping while also being flexible enough for comfortable wear.

The pouch 20 should be large enough to accommodate basic child care items such as diapers, baby wipes, and food or the like. Likewise, the opening of the pouch 26 should be large enough to facilitate easy removal and insertion of such items. The pouch 20 can be composed of a material with sufficient stiffness or which can be fabricated as such that it retains its shape while supporting items stored in the pouch 20, pockets 31, 32, and 33, and additionally, items dangling from the tether assemblies 50 which are removably attached to D-rings 40. The flap 28 closes the opening of the pouch 26 and secures the items stored inside the pouch 20 whereby when the flap 28 is folded over, hook strip 30*a* attached to the underside of flap lip 28*a* pressure adheres to latch strip 30*b* attached to the outer wall of the pouch 21. Each of the pockets 31 and 32 should be large enough to store small child play items. The pockets can be made expandable by attaching a piece of flexible material longer at the opening 36 than the length it is to cover on the pouch 20 to the outer wall of the pouch 21, thereby permitting it to expand away from the outer wall of the pouch 21 when filled.

Pocket 33 can be formed in the shape of a cylinder, and of such a size to accommodate a standard 12 oz. cylindrical baby bottle. Each of the pockets 31, 32, and 33 comprise an elasticized neck 38 at the opening 36 to secure items stored in the pockets and to facilitate easy insertion and removal of such items by the main rider when riding.

D-rings 40 are provided for removably attaching the clip 52 of the tether assembly 50 and are placed about the pouch 20 such that a main rider can easily reach behind him or her and retrieve a dropped item dangling from the tether assembly 50.

The clip 52 of the tether assembly 50 can removably fasten to a D-ring 40 on the pouch 20. The loop 56 of the tether assembly 50 can be placed around a child play item or even a baby bottle and secured by releasing a spring pressure of the locking mechanism 62 and sliding the locking mechanism 62 along the line 54 until the loop 56 is tight around the object, then applying spring pressure of the locking mechanism 62, thereby removably fastening the item to the tether assembly 50. It is intended for a number of tether assemblies to be provided as part of cycling belt 10 and 10' to correspond with the number of associated D-rings. Items not in use by the child can either dangle by their respective tether assembly 50 or be stored in their respective pockets 31, 32 or 33.

Referring now to FIG. 4, a cycling belt 10' includes a pouch 20' which is similar to the pouch 10 in FIG. 2 but is form-shaped into a 3-dimensional rectangle and comprises a backwall 22', sides 24', a bottom 27', an outer wall 21', an opening 26', and a flap 66. The pouch 20' is attached to the band 12 in the same manner as described for pouch 20 in FIG. 2. The flap 66 is also form-shaped and comprises a back wall **66*a*, sides 66*b*, a lip 66*c*, and a top 66*d*. When folded over, the lower edge of the flap sides 66*b* and flap lip 66*c* meet the opening of the pouch 26'. A conventional slide fastener 64 is attached to the lower edge of the flap sides 66*b* and flap lip 66*c* and to the pouch opening 26' as illustrated. Expandable pockets 31' and 32' are rectangular shaped and are attached to the outer wall of the pouch 21' in the same manner as pockets 31 and 32 in cycling belt 10. Pocket 33' is cylindrically shaped and is attached to a side of the pouch 24'. All pockets 31', 32', and 33' comprise an elasticized neck 38' at the opening 36'. D-rings 40' are attached to the bottom edge of the outer wall of the pouch 25' centered under the corresponding pockets 31' and 32'. Another D-ring 40' is attached to the band 12 near the side of the pouch 24' where pocket 33'** is attached.

The pouch 20' can be composed of a substantially rigid material or can be fabricated as such to retain its shape while supporting items stored in the pouch 20', pockets 31', 32', and 33', and additionally items dangling from the tether assemblies 50.

The cycling belt 10' of FIG. 3 presents another configuration of the same components as the cycling belt 10 of FIGS. 1 and 2 and therefore operates in the same fashion and possesses the same advantages as those described above for cycling belt 10.

SUMMARY, RAMIFICATIONS, AND SCOPE

Accordingly, the reader will see that the cycling belt of this invention is very useful for cycling trips of any length with a child in a carrier seat. With this cycling belt, adequate storage is provided for basic child care items and a child can be furnished with a play item or even a bottle of refreshment without fear of the item falling to the ground and causing a safety hazard to the riders, disruption of the trip, or damage or breakage to the item. Also, these play items can be stored when not in use rather than dangle from the tether assemblies. Further, the cycling belt can be quickly and easily removed at stops, when not cycling with a child in a carrier seat, or whenever desired.

Although the description above contains many specificities, these should not be construed as limiting the scope of the invention but as merely presenting illustrations of some of the presently preferred embodiments of this invention. For example, the pouch can have other shapes, the pockets can be attached directly to the band, the D-rings can be attached directly to the band, etc.

Thus, the scope of this invention should be determined by the appended claims and their legal equivalents, rather than by the examples given.

What is claimed is:

1. A cycling belt for use when cycling with a child in a child carrier seat comprising:

a band portion having two ends;

a fastener for removably fastening said two ends of said band portion together to form a continuous loop;

means for adjusting the length of said band portion to vary the size of said continuous loop;

a pouch depending from said band portion, said pouch having a top, a bottom, a back wall, and an outer wall, said back wall connected to said top at a back upper edge thereof and connected to said bottom at a back lower edge thereof, said outer wall connected to said bottom at an outer lower edge thereof and releasably fastened to said top at an outer upper edge thereof, said back wall of said pouch permanently attached adjacent said back upper edge to said band portion such that said back lower edge of said back wall hangs below said band portion;

a plurality of expansible pockets attached to said outer wall of said pouch, at least one of said pockets having a bottom edge extending below the outer lower edge of said outer wall;

a rigid ring attached to said outer lower edge of said outer wall of said pouch; and at least a first tether including:

a line having a first end and a second end, a fastener attached to said first end of said line, said fastener being releasably attached to said rigid ring, a loop integral with said second end of said line, said loop having a circumference, and means for selectively varying the circumference of said loop.

2. The belt of claim 1, wherein said band portion is fabricated from webbing material.

3. The belt of claim 1, further comprising a closure attached to said pouch for releasably fastening said outer upper edge of said outer wall to said top, said pouch defining an opening, said closure being selectively displaceable between an open and closed position to respectively expose and conceal said opening.

4. The belt of claim 3, further comprising a fastening assembly, said fastening assembly releasably fastening said closure in the closed position.

5. The belt of claim 4, wherein said fastening assembly includes a hook strip and a latch strip, said hook strip being engageable with said latch strip.

6. The belt of claim 4, wherein said fastening assembly includes a slide fastener.

7. The belt of claim 1, further comprising:

an additional expansible pocket attached to an adjacent section of the outer wall of said pouch;

an additional rigid ring attached proximate the center of said pouch; and an additional tether releasably attachable to said additional rigid ring.

* * * * *